United States Patent [19]

Sheber

[11] Patent Number: 4,463,525

[45] Date of Patent: Aug. 7, 1984

[54] HAND-HELD CLEANING TOOL WITH REMOTE WATER TURBINE POWER SOURCE

[76] Inventor: Thomas F. Sheber, 640 W. Chapala Dr., Tucson, Ariz. 85704

[21] Appl. No.: 351,145

[22] Filed: Feb. 22, 1982

[51] Int. Cl.[3] ..... B24B 23/02

[52] U.S. Cl. ..... 51/170 R; 51/134.5 F; 51/268; 15/1.7

[58] Field of Search ..... 51/170 R, 170 T, 170 PT, 51/134.5 F, 268, 272, 273, 180; 15/1.7, 385, 383, 387, 321

[56] References Cited

U.S. PATENT DOCUMENTS

| | | | |
|---|---|---|---|
| 705,550 | 7/1902 | Ballard | 51/170 R |
| 1,024,151 | 4/1912 | Smith | 51/170 R |
| 1,856,631 | 5/1932 | Hackenberg | 51/134.5 F |
| 3,291,145 | 12/1966 | Arneson | 15/1.7 |
| 3,928,947 | 12/1975 | Millett | 51/170 T |
| 4,193,228 | 3/1980 | Bowler | 51/134.5 F |

FOREIGN PATENT DOCUMENTS

| | | | |
|---|---|---|---|
| 60824 | 4/1975 | Australia | 15/1.7 |
| 13601 | of 1897 | United Kingdom | 51/272 |

*Primary Examiner*—Roscoe V. Parker

*Attorney, Agent, or Firm*—Cahill, Sutton & Thomas

[57] ABSTRACT

A hand-held tool with a rotary pumice or suitable synthetic grinding wheel is connected by means of a flexible drive cable to a remote water turbine contained in a floating housing and is used to remove calcium deposits from decorative tile around a periphery of a swimming pool. The outlet of the water turbine is connected to one end of a suction hose, the other end of which is connected to a suction inlet of an electric pump/filter unit, causing water to be drawn from the swimming pool through the turbine. In an alternate embodiment of the invention, the remote turbine is placed in a lavatory sink. Water from a faucet is forced through the turbine, causing rotation of the drive cable, so that the hand tool can be used to clean calcium deposits from bathroom facilities.

9 Claims, 11 Drawing Figures

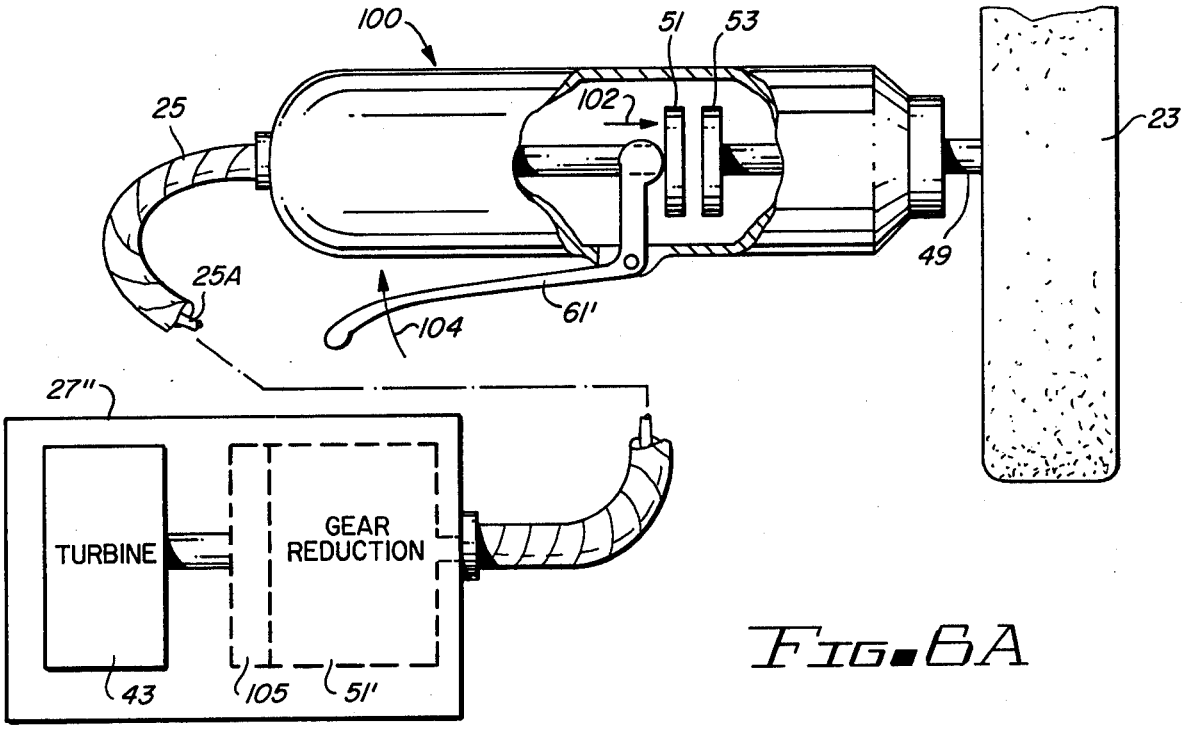
FIG. 6A
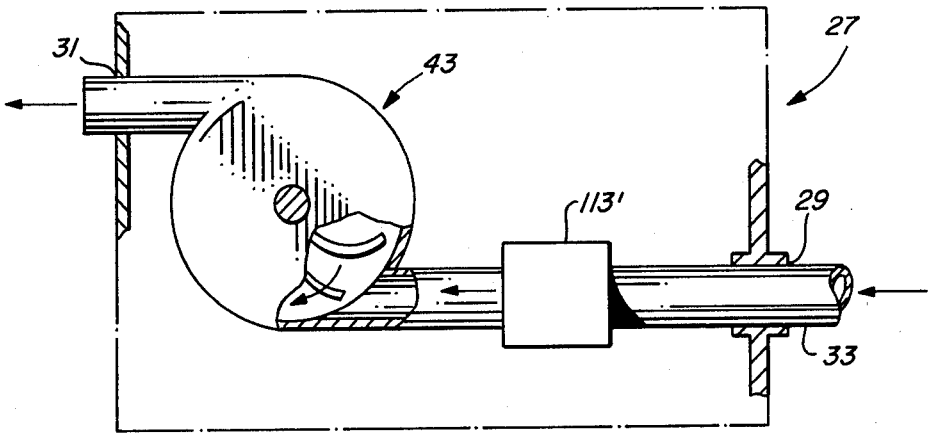
FIG. 7A
FIG. 7B
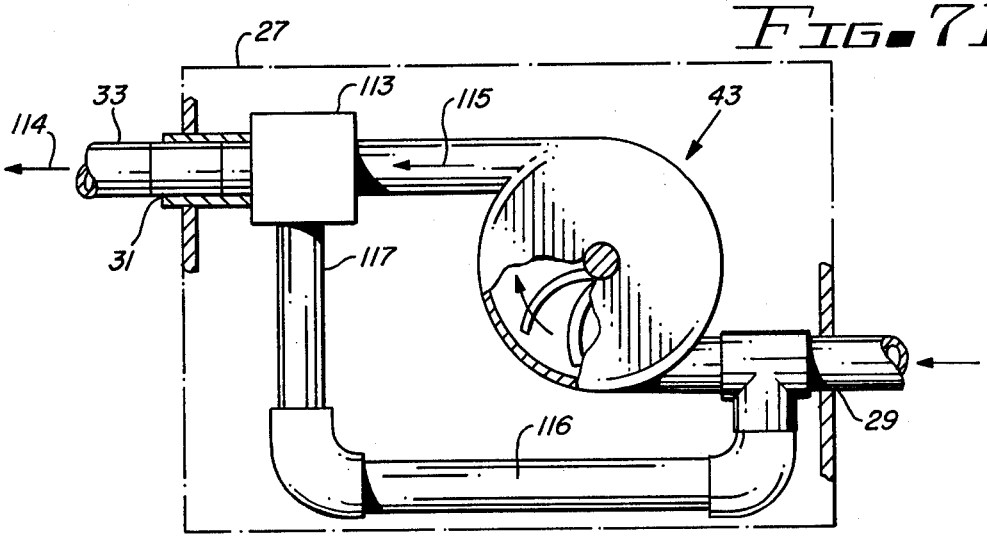

HAND-HELD CLEANING TOOL WITH REMOTE WATER TURBINE POWER SOURCE

BACKGROUND OF THE INVENTION

The invention relates to hand-held cleaning tools for cleaning mineral deposits from various surfaces, such as decorative swimming pool tiles, and from other surfaces such as the interiors of toilet bowls, and more specifically to such tools which are driven by remote water powered turbines connected by means of flexible drive cables to hand tools.

Swimming pools typically have water circulation and filtering systems including electrical suction pumps that are driven by electric motors to draw water out of an outlet located near the surface of the swimming pool, to force the water through a filter, and to return the filtered water to the pool. Many swimming pools include a peripheral ring of decorative tile at the water level. If the swimming pool water is "hard" in the sense that it contains substantial amounts of dissolved minerals, mineral deposits inevitably build up on the decorative tile, and are quite unattractive. Removal of such mineral deposits is a difficult and tedious chore. Typically, removal of calcium deposits is accomplished by using commercially available hand-held pumice blocks that are briskly rubbed against the deposits on the tile. Since pumice is much softer than the surface of the tile, it gradually grinds away the mineral deposits but does not scratch the surface of the tile. Ordinarily, one would not use electrically powered equipment, such as a grinding wheel on the drive shaft of a typical electric drill, to remove the above-mentioned calcium deposits from decorative tile. There are several reasons why this is true. For example, there is a danger that the user could be electrically shocked by using an electric tool in contact with water in the swimming pool. Electric hand tools of the type that are commercially available are not capable of providing the high torque, low rpm rotation that would seem to be needed to effectively clean calcium deposits from decorative tile without damaging the surface of the tile. Pumice grinding blocks are also utilized for removing calcium and other mineral deposits in toilet bowls. Again, electrically powered hand tools are obviously not well suited for this task.

There appears to be an unmet need for an inexpensive, yet effective non-electric power tool capable of performing the above described operations of removing calcium and other mineral deposits from surfaces of various water containing vessels, such as swimming pools or toilet bowls, without creating the hazard of electrical shock to the user and without damaging the underlying surface on which the mineral deposits are formed and it is an object of the invention to provide such a power tool.

SUMMARY OF THE INVENTION

Briefly described, and in accordance with one embodiment thereof, the invention provides an apparatus for cleaning mineral deposits and the like from decorative tiles surrounding the periphery of a swimming pool at the water level thereof and/or the plaster interior surface of the swimming pool, the apparatus including a hand tool with a rotary drive shaft attached to a pumice or suitable synthetic grinding wheel, the apparatus also including a remote water turbine and a flexible, relatively long drive cable for transmitting rotary power from the turbine to the hand tool, the water turbine being driven by a suction hose coupled to the suction inlet of an electric pump/filter system used in conjunction with the swimming pool or by water under pressure, such as water from a faucet or pool water return line. In use, an operator holding the hand tool presses the grinding wheel against the mineral deposits. The grinding wheel, being composed of pumice or a suitable synthetic material, grinds away the mineral deposits, consuming part of the pumice or synthetic material wheel during the operation, but, because of the relative softness of the grinding wheel, does not scratch the underlying surface of the decorative tile. In one described embodiment of the invention, the hand tool includes a trigger-actuated clutch coupling the drive cable assembly to a drive shaft or chuck to which the grinding wheel is attached. The turbine unit is enclosed in a buoyant housing that floats in the swimming pool so the user can easily pull the buoyant housing close to the tile to be cleaned next. An outlet of the turbine unit is coupled to one end of a long flexible hose, the other end of which is coupled to the suction inlet of the pool pump/filter system. The inlet of the turbine unit is below the surface of the swimming pool water, so that when the swimming pool pump is turned on, the suction produced thereby draws pool water through the turbine, causing its rotor to turn, and thereby causing the flexible drive cable and the grinding wheel to turn. A gear reduction unit is utilized to provide a suitable rotation rate and/or torque to accomplish efficient grinding of the mineral deposits without damage to the underlying tile surface. Since the pumice or synthetic grinding wheel is softer than the surface of the tile, the tile surface is not scratched. In one embodiment of the invention, casters are provided on the bottom of the housing to allow it to roll along the bottom of the pool, if the housing is not buoyant. In another embodiment of the invention, the turbine rotor is driven by water under pressure, rather than by suction of water, and the turbine housing is adapted to be placed in a lavatory sink or the like, with its inlet coupled to a faucet or other source of water under pressure. The water from the faucet is forced through the turbine, causing the turbine rotor, the flexible drive cable, and the grinding wheel to turn. The hand tool is deployed by a user to remove mineral deposits from the surface of a toilet bowl and/or other bathroom facilities. A control valve is provided to turn the turbine on and off and control the speed of and/or torque produced by the turbine rotor.

BRIEF DESCRIPTION OF THE DRAWINGS

FIG. 6A is a partial perspective view of an alternate hand tool that is useful in conjunction with the devices of FIGS. 3 and 6.

FIG. 7A is a schematic diagram of a speed/torque control valve that is useful in the embodiments of the invention shown in FIGS. 3 and 6.

FIG. 7B is a schematic diagram of another speed/-torque control valve that is useful in the embodiment of the invention shown in FIG. 3.

DESCRIPTION OF THE INVENTION

Figure 1:
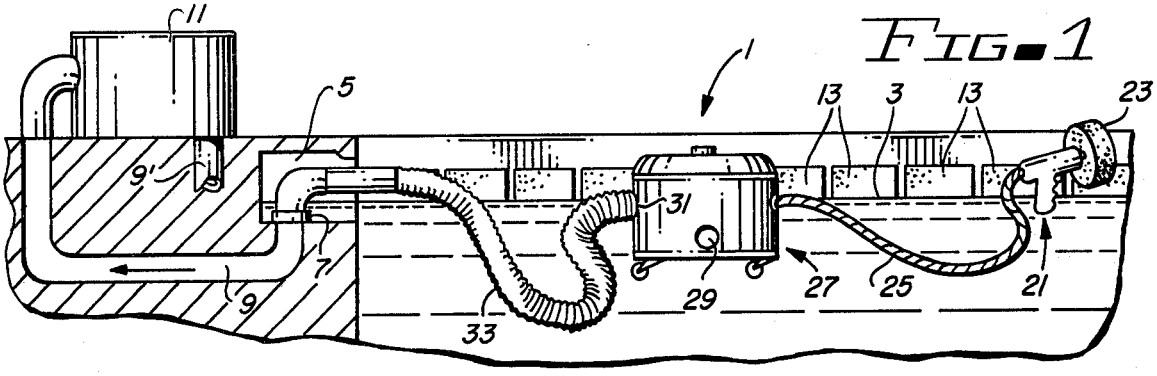
FIG. 1 is a partial section view showing one embodiment of the invention in a swimming pool and connected to a pump/filter system.
Figure 2:
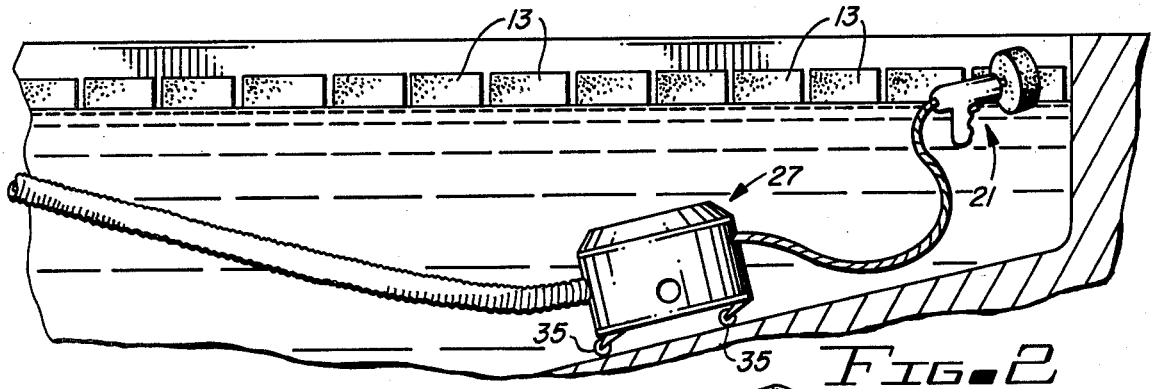
FIG. 2 is a partial section view showing the cleaning apparatus of FIG. 1 with a non-buoyant housing.

Referring now to the drawings, a conventional swimming pool 1 is shown in FIGS. 1 and 2. Reference numeral 3 designates the surface of the water, along which a plurality of decorative tiles 13 are attached to the vertical walls of the swimming pool. In the section view of FIG. 1, reference numeral 5 generally designates a region which is partially above and partially below the pool water level in which a pool outlet is disposed below the water surface. The pool outlet is connected by means of underground pipe 9 to the inlet of a conventional electric water pump/filter system designated by reference numeral 11. Reference numeral 9′ designates an underground return pipe that returns water passing through pump/filter unit 11 into the swimming pool.

As is entirely conventional, the water outlet of the swimming pool, which also serves as the inlet to pump/filter system 11, includes a coupling element designated by reference numeral 7. The coupling element 7 allows a flexible suction hose 33 to be coupled to pipe 7. Flexible hose 33 is ordinarily used for connection to a vacuum sweeper device for cleaning the bottom of the pool. It is important that the coupler 7 be located below the water surface level of the pool to prevent air from being sucked into pipe 9, since such air can cause depriming of the electric pump contained in pump/filter unit 11.

As previously mentioned, the surfaces of decorative tile 13 inevitably become covered with mineral deposits, especially calcium deposits, which are difficult to remove. According to the present invention, the pumice or synthetic grinding wheel 23 is provided on the end of a hand-held, trigger-actuated tool 21 for grinding the deposits off of the surface of decorative tiles 13. A flexible drive cable assembly 25 has one end connected to hand tool 21 to provide rotary power to hand tool 21. The other end of drive cable assembly 25 is connected to a water powered turbine 43 (FIG. 3) contained in a buoyant housing 27. Drive cable 25 includes an inner rotating core 25A and an outer protective sleeve 25B. The rotary core 25A is coupled, either directly or by means of a gear reduction unit (not shown), to the rotor 43A of turbine 43.

Water powered turbine 43 has a water inlet 29 and a water outlet 31 arranged such that water forced from inlet 29 to outlet 31 causes rotation of rotor 43A, as is well known. Water inlet 29 can alternately be fitted with an adaptor to receive the discharge end of a standard garden hose or the like, and flexible hose 33 then may be removed from water outlet 31 to permit water to discharge after it has passed through the turbine and has induced the desired rotary motion to rotor 43A.

In accordance with one enbodiment of the invention, housing 27 is buoyant by virtue of being partially hollow and waterproof except for a top opening 45 into which a plug 47 can be screwed. If desired, plug 47 can be removed and the housing can be filled with water, so that the entire housing, with the turbine unit 43 therein, is not buoyant and sinks to the bottom of the pool. Casters 35 (FIG. 2) are provided on the bottom of housing 27 to permit the unit to roll along the bottom of the swimming pool, if this is desirable.

The free end of flexible hose 33 is coupled by means of an airtight connection to turbine outlet 31. Preferably, outlet 31 is below the surface of the water for suction-type operation of the turbine so that no air can be sucked into hose 33 even though an inexpensive coupling is used between the free end of hose 33 and the turbine outlet 31. Inlet 29 is always below the water surface when suction flow is used, to prevent depriming of the circuit through which the water flows. When the source of water under pressure is from a garden hose or a faucet, this requirement of submersion of inlet 29 is unnecessary.

Referring to FIG. 7B, the torque and speed of the rotor 43A of turbine 43 can be controlled by means of a control valve 113 that can be set to cause all water drawn out of suction hose 33 in the direction indicated by arrow 114 to flow through the outlet of turbine 43, as indicated by arrow 115. Alternately, control valve 113 can be set so that all water flowing out of suction hose 33 in the direction of arrow 114 flows through the housing inlet 29 and through bypass pipe 116, in the direction indicated by arrow 117. The first mentioned setting of control valve 113 produces maximum speed and torque of the rotor of turbine 43, while the second mentioned setting in effect "turns off" hand-held tool 21, while permitting water to be drawn through suction hose 33, thereby preventing "overloading" of pool pump 11.

Figure 3:
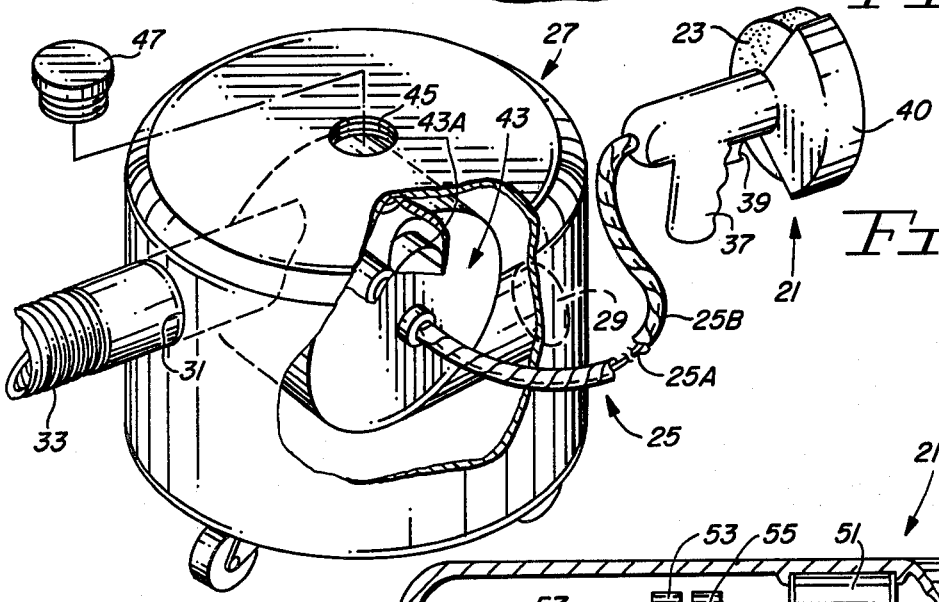
FIG. 3 is a partial cutaway perspective view useful in describing the invention.
Figure 3A:
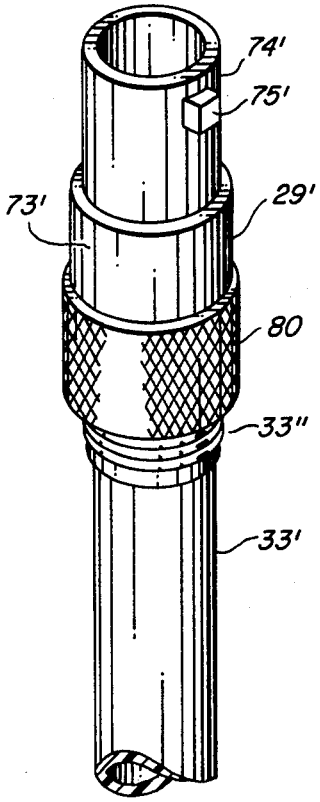
FIG. 3A is a partial perspective view of a hose connection adaptor useful in conjunction with the embodiment of FIGS. 3 and 6.
Figure 3B:
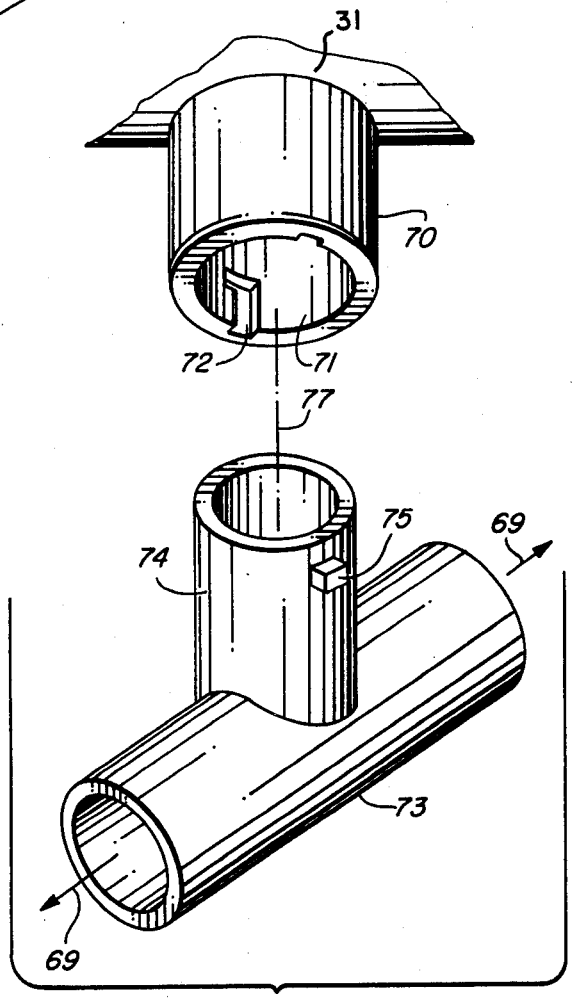
FIG. 3B is a perspective view of a balanced outlet ejection element and adaptor for connection thereof to the embodiment of the invention shown in FIG. 3.

At this point, it will be helpful to describe the adapters shown in FIGS. 3A and 3B in detail. If, instead of using suction hose 33 and the swimming pool pump 11 as a source of motive power for hand-held tool 21, it is desired to use an ordinary garden hose (thereby performing the dual function of filling the swimming pool and also providing power for hand-held tool 21), the adapter shown in FIG. 3A can be utilized to connect the standard male hose connector of an ordinary garden hose to turbine inlet opening 29. The T-shaped outlet element 73 shown in FIG. 3B then can be utilized to produce "balanced" ejection of water from turbine outlet 31 so that the counteracting forces prevent undesired rotation or movement of housing 27. Still referring to FIG. 3B, reference numeral 70 denotes the configuration of an adapter that is connected to outlet 31 to achieve connection of T-shaped outlet element 73 to outlet 31. A cylindrical opening 71 of adapter 70 has at least one L-shaped slot 72 for accommodating a corresponding square peg 75 on T-shaped outlet element 73. Dotted line 77 indicates the engagement of one of square pegs 75 into a corresponding one of the L-shaped slots 72 in FIG. 3B. The diameter of opening 71 is such that a conventional "slip fit" end of an ordinary swimming pool suction hose can easily, but snuggly fit therein. T-shaped outlet element 73 can be inserted into adapter 70 and rotated clockwise to lock it into position. When T-shaped balanced outlet element 73 is locked into position (normally below the water level of the swimming pool), water is ejected horizontally in the two opposite directions indicated by arrows 69 in FIG. 3B.

Hose adapter 73′ of FIG. 3A can be similarly connected to inlet 29 (FIG. 3) by means of an adapter that is essentially identical to inlet 70 of FIG. 3B. Reference numeral 80 in FIG. 3A designates a collar of a conventional female hose connector, and reference numeral 33′ designates an ordinary garden hose supplying water at a high pressure to inlet 29. Reference numeral 33″ designates a standard male hose connector connected to garden hose 33′.

At this point, it is convenient to refer to FIG. 7A, which shows a schematic diagram including a second control valve 113′ coupled between housing inlet 29 and the inlet of turbine 43. Control valve 113′ is useful for controlling the rate of flow of water supplied at high pressure through garden hose 33′ and hence controls the speed of and torque provided by the rotor of turbine 43. Although a bypass pipe such as the one shown in FIG. 7B could be provided, this will ordinarily be unnecessary, because turning control valve 113′ off cannot result in any damage to the swimming pool pump 11, as could happen if valve 113 of FIG. 7B is turned completely off and there is no bypass pipe 116.

Figure 6:
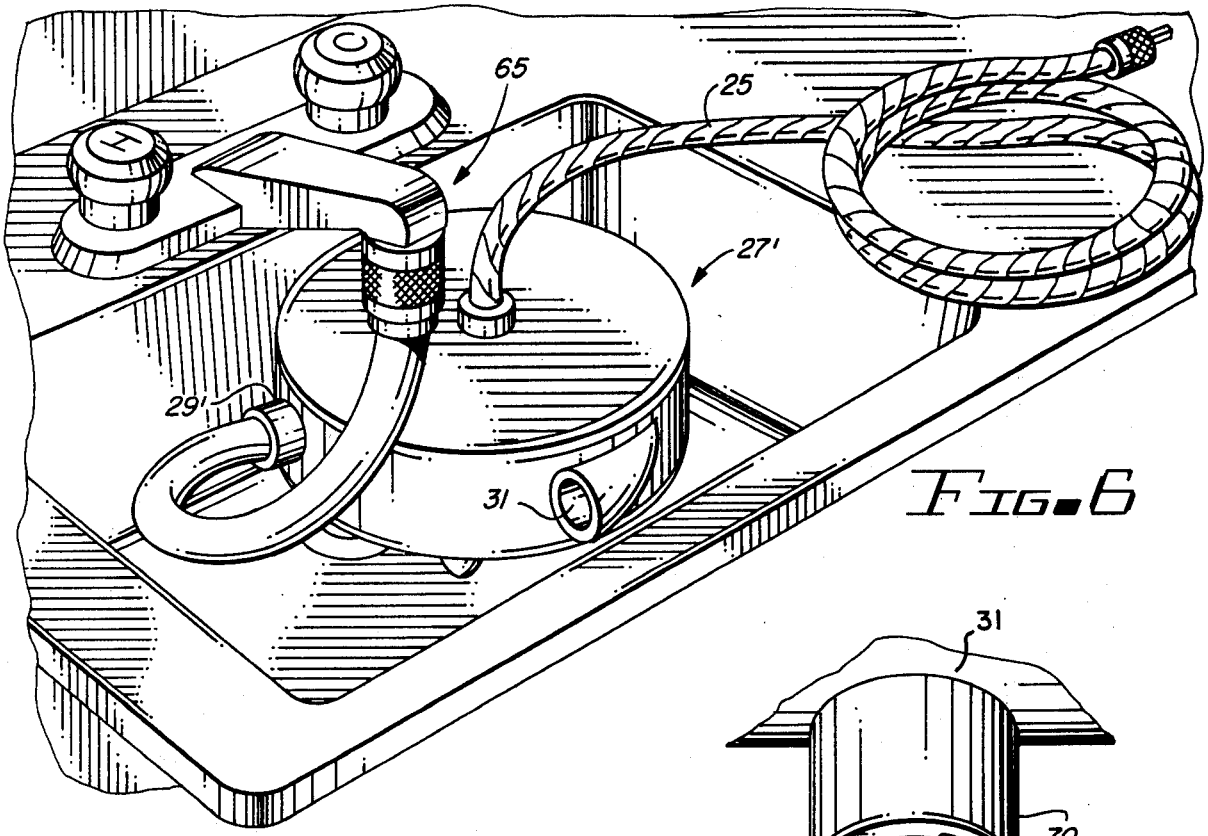
FIG. 6 is a partial perspective view of an alternate embodiment of the invention.

FIG. 6A discloses an alternate hand-held tool 100 having a tubular configuration, rather than a pistol-grip configuration. This configuration may be preferable to the one shown in FIG. 4 for either swimming pool cleaning purposes or toilet bowl cleaning purposes. As before, a clutch is shown having plates 51 and 53. Clutch plates 51 and 53 engage, as indicated by arrow 102, when trigger 61′ is squeezed in the direction indicated by arrow 104, thereby mechanically coupling pumice grinding wheel 23 to the rotary core element 25A of flexible cable 25. In hand-held tool 100, the gear reduction unit 51 of FIG. 4 has been omitted, and instead a gear reduction mechanism 51′ has been provided in housing 27″, which could be either housing 27′ of FIG. 6 or buoyant housing 27 of FIG. 3. The input of gear reduction unit 51′ is connected to the rotor of turbine 43. If desired, a flywheel 105 is provided on the output shaft of the turbine rotor of turbine 43.

Figure 4:
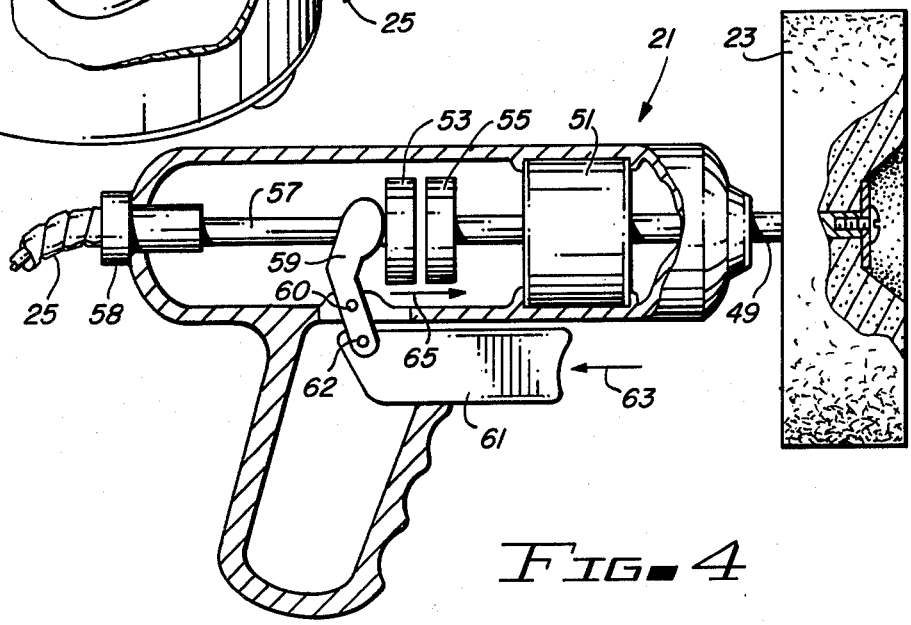
FIG. 4 is a partial cutaway section showing the interior components of the hand tool shown in FIGS. 1–3.

Referring now to FIG. 4, one preferred embodiment of the hand-held tool 21 is shown, wherein pumice or synthetic grinding wheel 23 is removably attached to drive shaft 49. Rotary drive shaft 49 passes through a waterproof bearing to the output side of a gear reduction unit 51 contained within the housing of hand tool 21. The input side of gear reduction unit is connected by a shaft to one plate 55 of a clutch mechanism. The other plate 53 of the clutch mechanism is connected to the outer sleeve of a telescopic sleeve-shaft element 57. An inner shaft element of the telescopic sleeve-shaft element 57 is connected to a waterproof bearing/coupler 58 to which one end of flexible cable 25 is removably attached. A clutch linkage 59 is pivotally connected to the housing of hand tool 21 by pin 60 and to a trigger 61 by means of a pin 62. The user can then utilize his index finger to pull trigger 61 in the direction indicated by arrow 63. This will cause clutch plate 53 to move in the direction indicated by arrow 65, thereby engaging plate 55 and transmitting rotary motion of cable core 25A to the drive shaft 49 whereby causing rotation of pumice or synthetic grinding wheel 23. Of course, a suitable trigger lock (not shown) can be provided to maintain the two clutch plates in positive engagement; and, of course, various other clutch-actuating arrangements can be provided on either side of the clutch plates, or the clutch even can be omitted.

Figure 5:
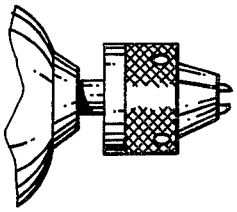
FIG. 5 is a partial perspective view of an alternate chuck utilized on the hand tool of FIG. 4.

Various means of connecting pumice or synthetic grinding wheel to drive shaft 49 are possible. For example, one approach would be to provide an axial stud on grinding wheel 23 and to provide a chuck of the type shown in FIG. 5 on drive shaft 49 for receiving the stud. Another approach would be to provide plastic shaft-receiving elements on each grinding wheel, wherein the end of drive shaft 49 could be square and would mate with a square hole in the center of such a coupling element.

As indicated in FIG. 3, a removable shield 40 can be provided on hand tool 21 to shield the user from water thrown by the rotating grinding wheel 23.

Although the gear reduction unit 51 shown in FIG. 4 adds somewhat to the weight of hand tool 21, it reduces the torque transmitted by the core 25A of cable assembly 25, thereby reducing erratic rotation of the pumice wheel under high torque condition due to springiness of the drive cable core 25A. In some instances, it may be preferable to include two gear reduction units, one in the hand tool 21 and another at the opposite end of cable assembly 25. In other intances, wherein high speed rotation of the drive shaft 49 is desired, no gear reduction unit is required at either end of cable assembly 25. However, for typical operations in cleaning the above mentioned calcium deposits from decorative tile 13, it is believed that in many instances relatively low speed (i.e., roughly one hundred to six hundred revolutions per minute), but relatively high torque rotation of grinding wheel 23 will provide an optimum trade-off between ease of use, efficient, scratch-free removal of calcium deposits, and minimum wear or consumption of the relatively soft pumice grinding wheel. This will result in friction levels and relative surface-to-surface velocity differences between the abrading surface and the tile surface that are not excessively different from those resulting from the previous method of utilizing hand-held pumice blocks and rubbing them against the calcium deposits. The latter approach has proved successful, is widely used to remove calcium deposits, and is known to not damage the finish of the decorative tile.

Referring now to FIG. 6, an alternate embodiment of the invention is shown, wherein a housing 27′ containing a suitable turbine unit (not shown) is placed in a lavatory sink. The water inlet adapter 29′ is coupled by means of a hose to a typical faucet 65. When the faucet is turned on, water is forced through inlet 29′, causing the turbine rotor to turn. The water is ejected through outlet 31 into the sink and drains away. Flexible cable 25 is driven by the rotating turbine rotor. Hand tool 21, modified in shape to be easily used in bathtub and toilet bowl cleaning operations, is connected to the free end of cable 25 as shown in FIG. 6.

A wide variety of different shapes can be provided for pumice or synthetic grinding wheel 23. Furthermore, different materials than pumice, such as composition plastic materials, can be used for making grinding wheel 23, if necessary, to avoid scratching of certain types of finishes and commonly found in bathroom facilities.

While the invention has been described with reference to a particular embodiment thereof, those skilled in the art will be able to make various modifications to the disclosed embodiments without departing from the true spirit and scope of the invention.

I claim:

1. Apparatus for removing mineral deposits from interior surfaces of water-containing vessels, said apparatus comprising in combination:

(a) a hand-held tool having a rotary drive shaft;

(b) a grinding wheel attached to said drive shaft;

(c) a relatively long flexible drive cable assembly having a non-rotary housing and a coaxial rotary cable core element, said drive cable assembly having a first end and a second end, said first end being connected to said hand tool, said cable core element being operatively coupled to said drive shaft to translate rotation of said cable core element to said drive shaft;

(d) a remote water-powered turbine connected to said second end of said drive cable assembly, said turbine including a rotor operatively coupled to said cable core element to translate rotation of said rotor to said cable core element, said turbine having first and second ports through which water is forced to cause said rotor to rotate, said turbine being supported in a housing that is buoyant to allow a user of said hand tool to easily pull said turbine along as said user deploys said hand tool to grind mineral deposits off of the interior surfaces of said swimming pool; and (e) means for forcing water to flow through said first and second ports to effect rotation of said rotor.

2. The apparatus of claim 1 wherein said grinding wheel is composed of pumice, or suitable synthetic material.

3. The apparatus of claim 1 including gear reduction means operatively coupled to said cable core element to reduce the rotation rate of said grinding wheel relative to said rotor.

4. The apparatus of claim 1 wherein said first port is an outlet port of said turbine and is coupled to one end of a flexible suction hose having a second end coupled to a suction inlet to a swimming pool pump system, said second port being an inlet port of said turbine and being located beneath the surface of the water in a swimming pool.

5. The apparatus of claim 4 wherein said housing includes a plug that can be removed to fill said housing with water so that said housing is not buoyant, said housing having caster means for allowing said housing to roll along the bottom of said swimming pool as said user pulls said turbine along to deploy said hand tool at various locations on the interior surface of said swimming pool.

6. The apparatus of claim 1 including shield means for partially shielding said grinding wheel to prevent said grinding wheel from throwing water outward relative to a surface from which mineral deposits are being removed as said grinding wheel rotates.

7. The apparatus of claim 2 wherein said pumice includes clutch means coupled between said cable core element and said drive shaft to effect selective engagement and disengagement of said grinding wheel from said turbine.

8. The apparatus of claim 2 wherein said pumice or synthetic grinding wheel includes attachment means for removable attachment to said drive shaft.

9. The apparatus of claim 1 wherein said second port is an inlet port of said turbine and is coupled to the outlet end of a flexible hose forcing water at relatively high pressure into said second port through said water-powered turbine, and out of said first port.

* * * * *